United States Patent [19]

Fürst Karl et al.

[11] Patent Number: 4,583,251

[45] Date of Patent: Apr. 22, 1986

[54] SEAT BATH UNIT

[76] Inventors: Fürst Karl, Reinprechtsdorferstrasse 23/11, 1050 Vienna; Lambert Kröll, Döblinger Gürtel 15/3, 1190 Vienna, both of Austria

[21] Appl. No.: 551,877

[22] Filed: Nov. 15, 1983

[30] Foreign Application Priority Data

| | | | |
|---|---|---|---|
| Nov. 15, 1982 | [AT] | Austria | 4153/82 |
| Feb. 18, 1983 | [AT] | Austria | 564/83 |
| May 20, 1983 | [AT] | Austria | 1862/83 |
| May 20, 1983 | [AT] | Austria | 1863/83 |

[51] Int. Cl.[4] ..... A47K 3/02

[52] U.S. Cl. ..... 4/555; 4/556; 4/557; 4/578; 128/66

[58] Field of Search ..... 4/555, 578, 556, 557, 4/559, 538; 128/66

[56] References Cited

U.S. PATENT DOCUMENTS

| | | | |
|---|---|---|---|
| 2,569,825 | 10/1951 | Otis | 4/556 |
| 3,423,769 | 1/1969 | Cowley | 4/556 |
| 3,719,960 | 3/1973 | Russell | 4/556 |
| 3,863,275 | 2/1975 | Brendgord et al. | 4/556 |
| 3,864,762 | 2/1975 | Finch et al. | 4/555 |
| 4,099,272 | 7/1978 | Sowder | 4/555 |
| 4,160,292 | 7/1979 | Kuether et al. | 128/66 |
| 4,202,060 | 5/1980 | Touze | 4/556 |

*Primary Examiner*—Henry K. Artis

*Attorney, Agent, or Firm*—Kurt Kelman

[57] ABSTRACT

A seat bath unit for elderly, frail or otherwise handicapped persons is provided wherein a sidewall of the bathtub is displaceable for complete opening to the seat part for access thereto. A catchment trough beneath the bathtub is provided for receiving the total amount of water from the bathtub when bathing is complete so that the bathtub can be quickly emptied.

16 Claims, 12 Drawing Figures

SEAT BATH UNIT

Figure 1:
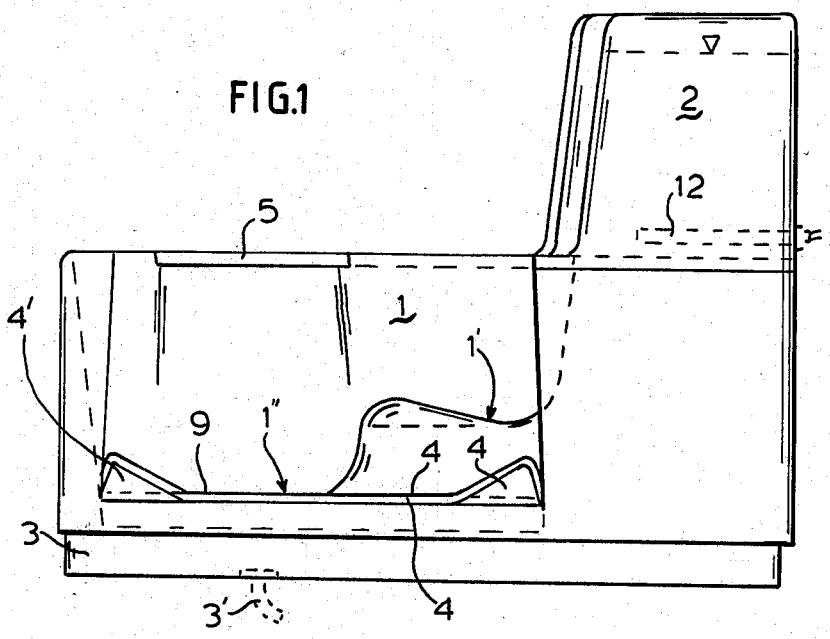

The invention relates to a seat bath unit for old, frail, or otherwise handicapped people, in which one sidewall can be moved away for complete opening up of the seat part.

Known constructions of this kind have the disadvantage that the person who is bathing must sit for a relatively long time in the bathtub, until the required amount of bathwater has run in, or has run out after the bath. Here the waiting time after the bath is particularly disadvantageous, in that the bathed person is still wet during this time, and this can easily lead to excessively low body temperature.

The object of the invention is to produce a bathtub unit of the kind mentioned in the beginning, in which after the bath the bather has to wait in the bathtub only a short time until it is emptied; it is to be possible to leave the tub quickly.

According to the invention, this problem is solved in that a catchment trough for the total amount of bathwater is provided beneath the bathtub. A particularly rapid letting out of the bathwater can be achieved with the construction according to the invention, since an overdimensioned outflow valve can be arranged in the bathtub so that the bathwater can first flow rapidly into the catchment trough and then flow out gradually through the drainpipe.

So as to enable leaving the bathtub as quickly as possible after the bathwater has run out, it being possible, however, to install the bathtub even in a dwelling in which there is no separate bathroom, according to a further feature of the invention the sidewall is movable downward under the bottom of the tub. Hence only one movable part is provided which needs to be sealed, and no extra space requirement exists, because of the movement underneath the tub floor. Advantageously, the movable sidewall can be formed by a part bent in a circular arcuate shape in cross section, and displaceable in lateral guides running in circular arcs and reaching beneath the floor of the bathtub, so that a particularly simple and stable construction of the wall guide system is achieved. Here the displaceable part can be angled out in its upper part, to lie, advantageously, in the same plane as the tub floor in the open position, with this upper part forming a footboard facilitating entering or leaving the bath. Furthermore, the displaceable part can be sealed relative to the stationary bathtub regions by conventional lip seals, so that a particularly easy displacement is facilitated, since the lip seals sealingly abut the displaceable part only due to the water pressure when the bath is full. Finally, the movable part can be formed by a flat plate which can slide in guides at its lower end and can pivot about bolts engaging in the guides, giving a particularly simple embodiment of the openable sidewall which is easy to construct.

Further features of the invention are characterized in the claims and are described below with reference to the examples of embodiments shown in the drawings.

Figure 2:
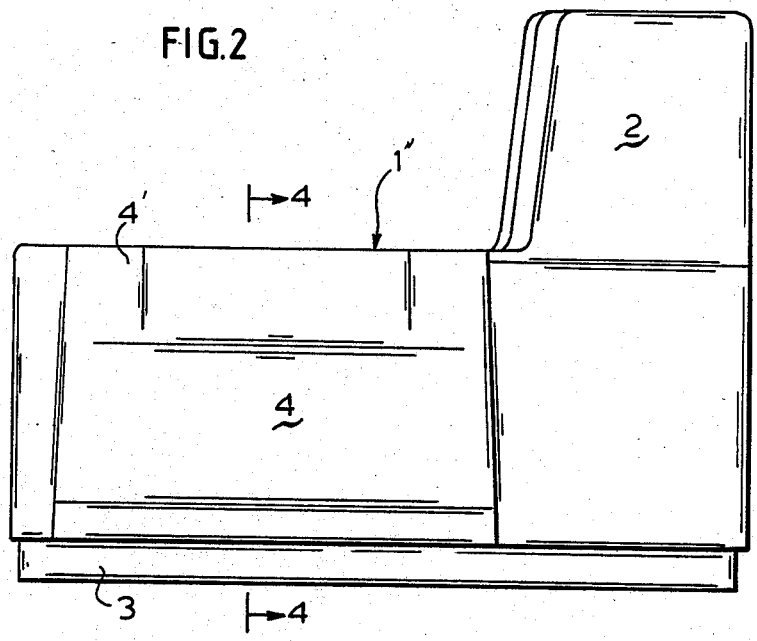
Figure 3:
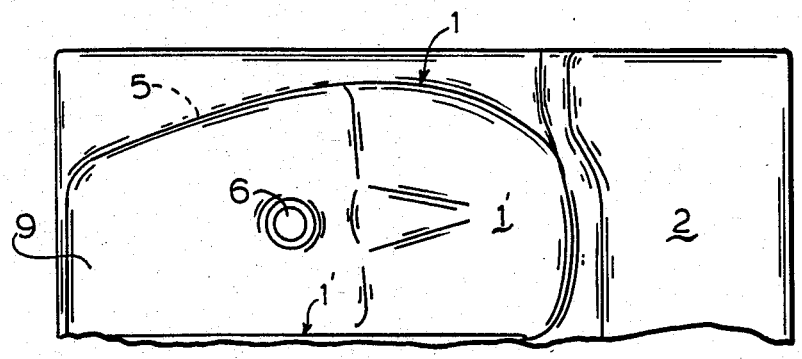
Figure 4:
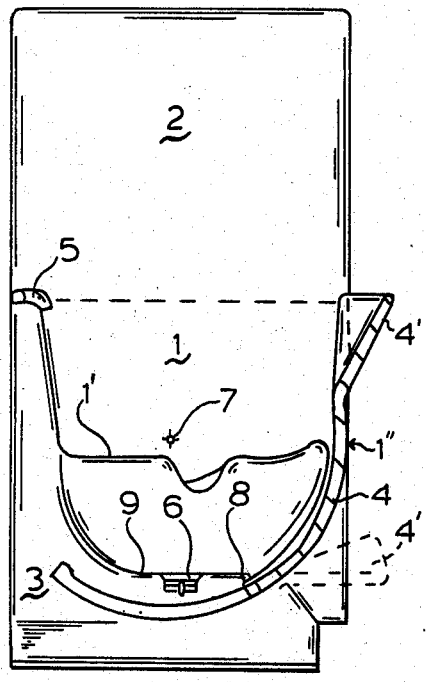
Figure 5:
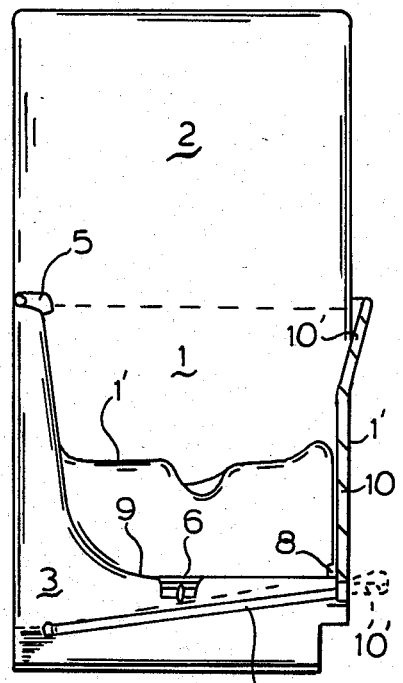
Figure 6:
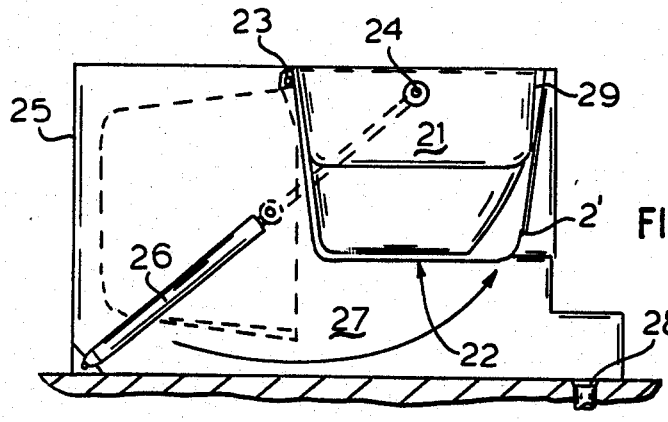

The drawings illustrate:

FIG. 1, a side view of the bathtub unit with the sidewall opened;

FIG. 2, an analogous side view, but with the sidewall closed;

FIG. 3, a plan view of the bathtub unit with the sidewall closed;

FIG. 4, a section along line IV—IV of FIG. 2;

FIG. 5, a section analogous to that of FIG. 4, but through a second example of an embodiment;

FIG. 6, a longitudinal section, and

Figure 10:
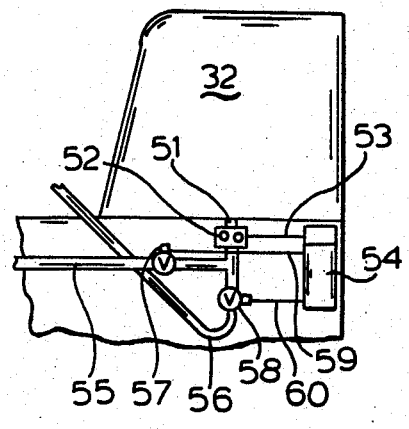
Figure 9:
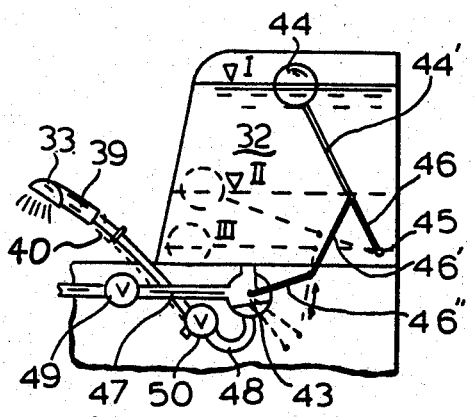
Figure 7:
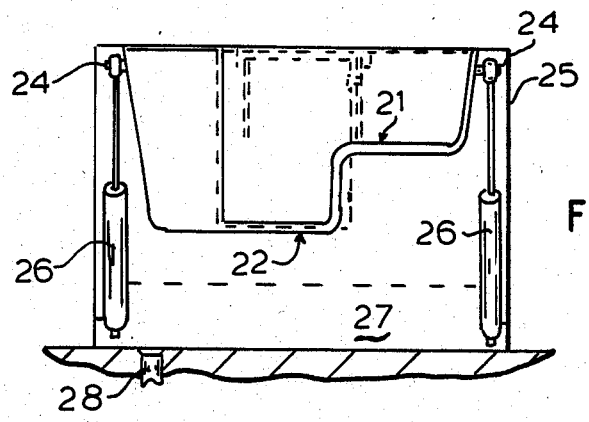
Figure 8:
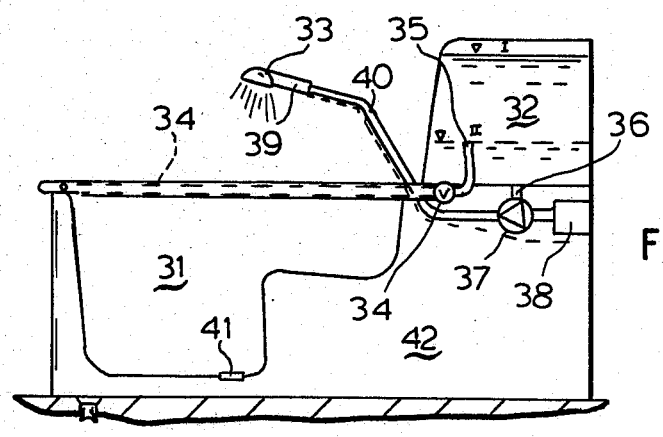
Figure 11:
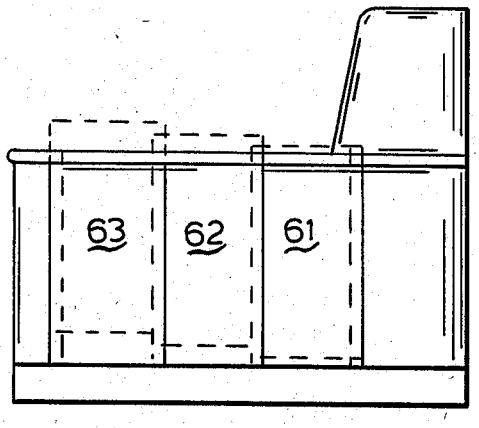
Figure 12:
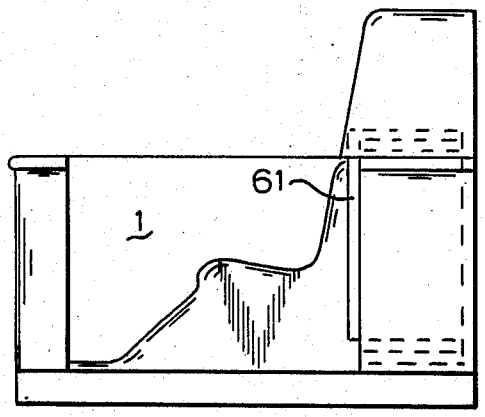

FIG. 7 a cross section, of a further example of an embodiment with a pivotable water container;

FIGS. 8, 9 and 10, various storage containers with a connection for a shower head; and FIGS. 11 and 12, a bathtub unit with a longitudinally displaceable sidewall.

The bathtub unit according to FIGS. 1–4 consists of a seat bathtub 1, an unpressurized storage container 2 for the bathwater, arranged at the head end of the tub and able to be supplied from the water supply, and a catchment trough 3 arranged beneath the bathtub 1 and provided with a drain 3′ (FIG. 1). The bathtub has a seat part 1′ and a movable sidewall 1″ which is formed by a part 4 that is displaceable downward beneath the bathtub floor 9. A bathwater infeed duct 5 is arranged at the upper edge of the tub. The outflow valve 6 of the bathtub 1 is dimensioned substantially larger than for a conventional bathtub, in order to make rapid emptying of the bathwater possible. The outflow valve 6 opens into the catchment tank 3, which forms a kind of buffer container between the outflow valve 6 and the drainpipe 3′.

The part 4 is curved in a circular arcuate shape in cross section; the center of curvature is denoted by 7 (FIG. 4). Lip seals 8 (FIG. 4) are provided, for sealing between the displaceable part 4 and the stationary bathtub regions. The displaceable part 4 is displaceable in lateral, equally curved guides which reach to below the bathtub floor 9. In the upper region 4′, the displaceable part 4 is angled outward, with the region 4′ forming, when the displaceable part 4 is pushed underneath the bathtub floor 9, an extension of the bathtub floor 9 and lying in the same plane as the latter.

In the embodiment according to FIG. 5, the movable sidewall 1″ is formed by a flat plate 10 which is guided in lateral guides 11 by bolts about which it is also pivotable. The guides 11 here run inclined somewhat downwards beneath the bathtub floor 9, in order to enable the upper region 10′, angled outward analogously to the first embodiment example, to be brought into the same plane as the bathtub floor 9, when the sidewall 1″ is opened. For closing the sidewall, stops are provided at the outer end of the guides 11, preventing the plate 10 being pulled out further, and so that the bolts guiding the plate 10 can be supported against them. The plate 10 is then folded up, pressed against the seals 8, and locked, giving a sealing closure of the bathtub.

FIG. 1 shows the bathtub unit in the state of readiness for a bath, namely with the sidewall 1″ opened. For this, the displaceable part 4 is pushed downward, with the outward-angled region 4′ forming a footboard to facilitate getting in (see FIG. 4, dashed position of the part 4). The required amount of bathwater, brought to the desired temperature, is prepared in advance in the storage container 2. An electrical heater bar 12 can be used for this, controlled by a manually adjustable thermostat which can be fixed in the set position by clamping; however, the bathwater can also be taken, for filling the storage container 2, from a conventional water heating plant, and in this case corresponding mixing apparatus must be provided for obtaining the desired temperature. After the desired temperature has been reached in the storage container 2, a second, release thermostat, operating independently of the control thermostat, releases the equipment for operation (double monitoring of temperature). An indicator lamp lights up, indicating readiness of the bathtub unit for operation. In addition, an indicator thermometer is also provided for monitoring the temperature. The bather now gets into place in the bathtub; this is relatively easy, because of the feely accesible seat part 1' of the bathtub, even for old and frail persons. After this, a press button located in the rim of the bathtub is actuated, upon which the displaceable part 4 is pushed upwards, e.g., by two hydraulic cylinders powered by water pressure from the mains, or by chains and chain wheels. As soon as the displaceable part 4 is in the end position, the water inlet is opened by a control switch and the bathwater flows into the bathtub 1 via the bathwater feed duct 5, and in fact along the inner wall of the bathtub. The hydrostatic pressure presses the lip seals 8 onto the displaceable part 4. Any water leaking out runs into the catchment trough 3, so that no water reaches the adjacent floor from the tub.

As soon as the bath is finished, the outflow valve 6 is opened by actuation of the press button, and the bathwater runs out very rapidly into the catchment trough below, which takes up the whole amount of bathwater because of its dimensions. A commercially available float switch can be provided in the catchment trough 3, to switch on the mechanism for lowering the displaceable part 4 when the water level is reached which is given by the whole amount of water that has flowed out from the bathtub 1. After the lowering motion is complete, the bather can leave the tub. Simultaneously, the catchment trough 3 slowly empties via the drainpipe 3' into the drain. Furthermore, temperature-adjusted bathwater is prepared in the storage unit 2 as described above, so that the bathtub unit is again ready for bath use.

The function of the embodiment example according to FIG. 5 is the same as that of the embodiment example according to FIGS. 1–4.

In both embodiments, the whole course of functioning can be controlled by a program controller, switched on by the press button located in the rim of the bathtub. The actuation of the individual valves and the movable sidewall can here take place electrically, hydraulically, or pneumatically.

In the embodiment example according to FIGS. 6 and 7, a stationary suspended seat part 21 is provided, about which a water container 22 is arranged. The water container 22 is oval in plane view and is pivotably mounted on a shaft 23 which runs parallel to the long axis of the water container and is fastened, locked against rotation, in its upper edge region. A bolt 24 is fastened to the water container 22 and is pivotably engaged by a hydraulic cylinder 26 articulated to the carrier part 25 for the seat part 21. A catchment trough 27 is arranged beneath the water container 22, with its capacity approximately corresponding to that of the water container. This catachment trough 27 is connected to the drain 28. The sidewall 22' of the water container 22 opposite the shaft 23 is provided with a discharge spout 29 which starts from the floor of the water container 22 and runs obliquely upwards and outwards.

At the beginning of the bath, the water container 22 is located in the position shown dashed in FIG. 6. The seat part 21 is freely accessible to the bather, who gets into place on the seat part 21 and actuates the hydraulic cylinder 26 which pivots the water container 22 into the position shown by full lines in FIG. 6. After completion of the pivoting motion of the water container 22, the bathwater is let into it. After the end of the bath, the hydraulics 26 are again actuated, and in fact in the sense of a pivoting of the water container 22 in the direction of the position shown dashed in FIG. 6. The water then flows quietly, i.e., not like a flood, into the catchment trough 27, from which it then flows slowly out through the drain 28. The seat part 21 is very rapidly released by the pivoting of the water container 22, so that the bather can leave the tub very soon after the bath.

In the embodiment examples according to FIGS. 8, 9 and 10, a storage container is provided which takes up the whole amount of bathwater and in which is provided a device for dividing the total amount of water into the amount of water flowing directly into the tub and the amount of water which can be supplied via a shower head. Hence the whole amount of water, that is, both the amount of water to be let into the tub directly and also the amount of water to be supplied with the shower head, is present at the same temperature, so that no unpleasant temperature changes occur during the course of the bath.

According to the embodiment example of FIG. 8, an overflow pipe 35 is provided for dividing the total amount of water present in the storage container 32; it is connected to the duct 34, which conducts out the amount of water to be let into the bathtub 31, and which can be shut off by a valve 34'. A duct 36 leads away from the floor of the storage container 32 and can supply the remainder of the water to the shower head 33. A pump 37 is built into this duct 36 and can provide the water pressure needed for showering. The pump can then be driven by a motor 38 which can be controlled, i.e., switched on and off, by means of a hand key 39 in the handle of the shower head 33, and in fact via the associated control lead 40. The motor 38 can here be constructed either as a low-current motor or as a water turbine that can be acted on by the pressure of mains water. The water level when the storage container 32 is filled with the total amount of water is indicated by I. II is the water level set after letting in the amount of water flowing directly into the bathtub 31. The drain opening 41 of the bathtub 31 further opens into a catchment trough 42, which can receive the total amount of water.

At the beginning of the bath, the valve 34' is opened, so that the amount of water flowing into the bathtub 31 can flow out of the storage container 32, and in fact via the overflow pipe 35 and the duct 34. When the water level reaches the overflow edge of the overflow pipe 35, the supply of water ends and the water level II has been established in the storage container 32. If the shower head 33 is now to be used, the motor 38 is switched on by the hand key 39 in the handle of the shower head 33 via the control lead 40, and the pump 37 coupled to the motor sucks in water via the duct 36 and pumps it into the shower head 33 until the container is empty or until the hand key 39 is no longer actuated and the motor 38 is thus switched off.

In the embodiment example according to FIG. 9, the storage container 32 is constructed as a pressure vessel, the device for dividing the total amount of water being formed by a three-way tap 43 which is actuated by a float 44 arranged on a pivot arm 44', via a lever linkage 46, 46', 46''. The pivot axis 45 of the pivot arm 44' is here brought out in a pressure-tight manner through the wall of the storage container 32, with the lever linkage engaging the pivot axis 45. The duct 51 leading to the three-way tap 43 starts from the floor of the storage container 32. Two ducts 47, 48 lead away from the three-way tap 43, a shut-off element, e.g. a valve 49, 50 respectively, being built into each of the ducts. The valve 49 is actuated at the beginning of the bath to let the water into the bathtub 31, and the valve 50 is actuated via the hand key 39 and a control lead 40 for use of the shower head 33.

At the beginning of the bath, the individual parts of the apparatus are located in the position shown by full lines, namely the bathwater at the level I and the float 44 in the fully raised position. To let the bathwater into the bathtub 31, valve 49 is opened, and the water is propelled directly into the bathtub 31 by the excess pressure present in the storage container 32, via the duct 51, the three-way tap 43, and the duct 47. When the required amount of water has flowed in, the water level in the storage container 32 has fallen to the level II, and the float 44 is located in the position shown dashed. Due to the lowering of the float 44, the pivot arm 44', via the shaft 45 passing through the container wall, pivots downwards the lever 46 which is located on the outside of the storage container 32 and is arranged, locked against rotation, on the shaft 45, and which then, via levers 46' and 46'', rotates the three-way tap 43 in the clockwise direction, so that water can no longer flow into the duct 47, but a connection to the duct 48 is established. Further outflow of the water via the latter duct is prevented by the valve 50 which is located in the duct 48 and which is in the closed position. For showering, the valve 50 is opened, so that the water is forwarded by the pressure present in the storage container 32 into the shower head 33, until the water level has fallen to the level III, so that the float 44 has assumed the position shown by dot-dashed lines. The pivot lever 44' has thereby rotated the three-way tap 43, via the lever linkage 46, 46', 46'', further in the clockwise direction until it completely closes the outlet from the storage container. Thus there remains in the storage container 32 a residual amount of water which prevents escape of the gas pressure; the storage container thus operates similarly to a expansion tank of a pump.

The embodiment according to FIG. 10 has, for dividing the total amount of water, a throughflow counter 52 which is in the duct leading away from the storage container 32 and which is connected via a control lead 53 to a control unit 54. The water duct leading away from the throughflow counter 52 is divided into a duct 55 leading directly in to the bathtub 31 and a duct 56 leading to the shower head 33. A shutoff element is provided in each of these ducts, in fact, valve 57 in duct 55 and valve 58 in duct 56; these valves 57, 58 respectively are connected to the control unit 54 via further control leads 59, 60 respectively.

At the beginning of the bath the valve 57 is opened, so that bathwater flows via duct 55 directly into the bathtub. When the preselected amount of bathwater, which is measured by the throughflow counter 52, has flowed into the bathtub, the control unit 54 closes the valve 57 via control lead 59, the amount of water needed for a showerbath being retained in the storage container. If the shower head is now actuated by means of the hand key 39 in its handle, the control unit 54 then opens valve 58 via control lead 60, so that water is supplied to the shower head via the duct 56.

In the embodiment example according to FIGS. 11 and 12, the bathtub 1 has a movable sidewall which is composed of three parts 61, 62, 63. The sidewall parts 61, 62, 62 are mutually sealed and also sealed with respect to the rest of the tub regions by lip seals, which run approximately parallel to the vertical edges of the sidewall parts.

In FIG. 12, the bathtub unit is shown in the state ready for a bath, namely with the sidewall opened. For this, the sidewall parts 61, 62, 63 are pushed over one another, so that the seat part of the bathtub is accessible completely freely.

We claim:

1. A seat bath unit for elderly, frail, or otherwise handicapped persons, comprising:

a bathtub having a seat part, a floor, and a sidewall which is displaceable for complete opening up of the seat part, said sidewall having a cross-sectional shape in the form of a circular arc and being movable downwards beneath the floor of the bathtub in lateral guides running in circular arcuate form reaching beneath the bathtub floor; and a catchment trough beneath the bathtub for receiving the total amount of bath water from the bathtub.

2. The seat bath unit according to claim 1 wherein the upper region of the displaceable sidewall is angled outwards and lies, in the open position, in the same plane as the bathtub floor.

3. The seat bath unit according to claim 1, wherein the displaceable sidewall is sealed with respect to stationary portions of the bathtub by conventional lip seals.

4. The seat bath unit according to claim 1, wherein the displaceable sidewall is formed as a flat plate which is displaceable at its lower end in guides and is pivotable about bolts which engage in said guides.

5. The seat bath unit according to claim 1, which includes a stationary suspended seat part about which is arranged a water container which is pivotably mounted to said seat bath unit in its upper region so as to pivot away from said stationary seat part.

6. The seat bath unit according to claim 5, which further includes a discharge spout, inclined upwards and outwards, in the sidewall of the water container opposite the pivotal mounting thereof.

7. The seat bath unit according to claim 5, wherein said water container is pivotable by means of a hydraulic cylinder.

8. The seat bath unit according to claim 7, wherein said hydraulic cylinder is operated by pressure supplied by the water main.

9. The seat bath unit according to claim 1, which further includes a storage container which holds the total amount of bath water.

10. The seat bath unit according to claim 9, which further includes means in the storage container for dividing the total amount of bath water into the amount of water flowing directly into the bathtub and the amount of water which can be supplied by means of a shower head.

11. The seat bath unit according to claim 10, wherein the means for dividing the bath water includes a three-way tap which is actuated by means of a float.

12. The seat bath unit according to claim 10, wherein the means for dividing the bath water includes an overflow pipe directing water to the tub, and a duct leading from the floor of the storage container to the shower head.

13. The seat bath unit according to claim 10, wherein the means for dividing the bath water includes a valve which is controlled by the amount of water which flows therethrough.

14. The seat bath unit according to claim 10, which further includes a pressure pump for pressurizing the water supplied to the shower head which can be driven by a motor controlled by a switch arranged in the handle of the shower head.

15. The seat bath unit according to claim 11, wherein said motor for driving said pressure pump is electrically operated.

16. The seat bath unit according to claim 12, wherein said pressure pump includes a turbine driven by the pressure supplied by the water main.

* * * * *

UNITED STATES PATENT AND TRADEMARK OFFICE

CERTIFICATE OF CORRECTION

PATENT NO. : 4,583,251

DATED : April 22, 1986

INVENTOR(S) : KARL FÜRST ET AL

It is certified that error appears in the above-identified patent and that said Letters Patent is hereby corrected as shown below:

Cover page, item 19, inventor's name should be --Fürst et al--.

Cover page, item 76, inventor's name should be --Karl Fürst--.

Signed and Sealed this

*Nineteenth* Day of *August 1986*

[SEAL]

*Attest:*

DONALD J. QUIGG

*Attesting Officer*

*Commissioner of Patents and Trademarks*